US005417431A

United States Patent [19]

Gluck

[11] Patent Number: 5,417,431

[45] Date of Patent: May 23, 1995

[54] TRADING CARD WITH THREE-DIMENSIONAL EFFECT

[75] Inventor: Adrian Gluck, Newport Beach, Calif.

[73] Assignee: Laservison Productions, Inc., Newport Beach, Calif.

[21] Appl. No.: 147,139

[22] Filed: Nov. 3, 1993

[51] Int. Cl.[6] ..... A63F 1/00; G09F 1/02

[52] U.S. Cl. ..... 273/293; 40/124.1

[58] Field of Search ..... 273/93 C, 93 R, 88, 273/244, 277, 282.2, 282.1, 293, 298; 40/1.5, 124.1, 159, 160, 427; 156/58, 59

[56] References Cited

U.S. PATENT DOCUMENTS

| | | | |
|---|---|---|---|
| D. 326,067 | 5/1992 | Mayers | D11/55 |
| 1,528,475 | 3/1925 | Gaunt | 40/1.5 |
| 1,636,222 | 7/1927 | Fox | 40/1.5 |
| 1,837,707 | 12/1931 | Follows | 248/456 |
| 1,987,215 | 1/1935 | Romig | 40/1.5 |
| 2,041,756 | 5/1936 | Gray | 40/159 |
| 2,101,683 | 12/1937 | Leigh | 248/456 |
| 2,731,749 | 1/1956 | Tarzian | 40/160 |
| 3,057,099 | 10/1962 | Fruchter | 40/160 |
| 3,137,080 | 6/1964 | Zang | 40/160 |
| 3,179,479 | 4/1965 | Freedman | 248/456 |
| 3,261,126 | 7/1966 | Marks | 248/456 |
| 3,868,283 | 2/1975 | Scheyer | 40/160 |
| 3,879,874 | 4/1975 | Broussard | 40/158 |
| 4,161,831 | 7/1979 | Restle | 40/160 |
| 4,200,222 | 4/1980 | Feuer | 229/92.8 |
| 4,475,659 | 10/1984 | Wells et al. | 211/55 |
| 4,530,863 | 7/1985 | Seeger | 428/13 |
| 4,944,968 | 7/1990 | Wagner | 428/13 |
| 4,995,508 | 2/1991 | Burley | 206/44 B |
| 5,103,579 | 4/1992 | Mayers | 40/1.5 |
| 5,152,042 | 10/1992 | Mayers | 29/160.6 |

FOREIGN PATENT DOCUMENTS 1513529 6/1978 United Kingdom ..... 273/282.1

OTHER PUBLICATIONS

*Newport News*, Sep. 10, 1992, "It's Once, Twice, Three Times a Trading Card", pp. 5-6.

*Primary Examiner*—Benjamin H. Layno
*Attorney, Agent, or Firm*—Lyon & Lyon

[57] ABSTRACT

There is disclosed herein a new form of card of the trading card type which provides a three-dimensional effect. The card includes a master sheet or card having a background picture, along with an action picture of a person printed or disposed on a substrate and which substrate is directly bonded to the surface of the card to provide a substantially continuous profile edge around the picture and which edge preferably is substantially perpendicular to the surface of the background picture. This arrangement enables a shadow to exist along this profile edge and to give an enhanced three-dimensional effect. The reverse side of the trading card preferably has detailed biographical information, detailed life sports statistics and a family picture or likeness. An alternative embodiment includes providing a profile picture of a person on a substrate and preferably with a pin on-the reverse side to enable the same to be worn on clothing. A display pad is also disclosed which includes a plurality of slits or slots, preferably arranged like player positions on a sports field, and into which cards of the present invention can be inserted for display or other purposes. Other applications to the present techniques and electronic retrieval of information from cards also are disclosed.

15 Claims, 6 Drawing Sheets

FIG. 3

30

I. This is My Life Adrian Gluck
Family: Born 12/18/47 Bucharest, Romania.
Father Movie Producer, retired, mother housewife.
Married Susan R.N. 5/70. 5 children 3mo. - 16yr.
1 older brother Food Scientist, Irvine, CA.
Matel Bassarab Hi School Bucharest - YearPres.,
soccer full back, star track&field 800 m.;
Imigrated Toronto Canada '64; Busboy, loaded
trucks til '65;
Education: Forest Hill HS Grad '67;Computer
Engineering,U. Toronto Grad.'70; MBA U. Toronto'70;
Work: '70-'72 Exxon Computer
Analyst; '72-'75 Reed Steahouse Mgr. Computer Dept;
'75-'80 Founder & Pres. Fortrex Systems Corp;
Sold out '81 then investor & consultant to '93;
'85 Moved Irvine, CA where Investor and/or founder:
Rainbow Tech., Upper Deck, CreditcardKey, FlatPlug,
Champion League Sports, Laservision Productions;
Favorites: Movie-Deer Hunter; Music-Mahler; Color-
Blue;Food-Weiner Schnizel; Book-Think & Grow Rich;
Person-Hinstein; Charity-O.C. Center Perf. Arts;
Country-Italy; Song-Lady in Red; Athlete-M. Jordan
Company-Hewlett Packard; Friend-Joseph Konowiecki;
Pastime: Movies with family;
Advice: "Never give up."
Biggest Moment: Birth of first daughter
Retirement: Composing music, playing violin,
community work
© 1993 LASERVISION PRODUCTIONS, INC.
Printed in the USA. All Rights Reserved

32

II. This Is My Family

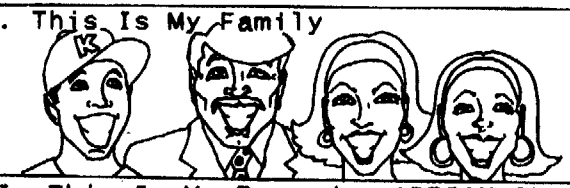

34

III. This Is My Record ADRIAN GLUCK

| YR | TEAM | AVG | G | AB | H | 2B | 3B | HR | RBI |
|---|---|---|---|---|---|---|---|---|---|
| 77 | PADRES | 66 | 143 | 545 | 145 | 24 | 6 | 9 | 41 |
| 78 | PADRES | 66 | 143 | 545 | 145 | 24 | 6 | 9 | 41 |
| 79 | YANKEES | 66 | 143 | 545 | 145 | 24 | 6 | 9 | 41 |
| 80 | YANKEES | 66 | 143 | 545 | 145 | 24 | 6 | 9 | 41 |
| 81 | YANKEES | 66 | 143 | 545 | 145 | 24 | 6 | 9 | 41 |
| 82 | YANKEES | 66 | 143 | 545 | 145 | 24 | 6 | 9 | 41 |
| 83 | YANKEES | 66 | 143 | 545 | 145 | 24 | 6 | 9 | 41 |
| 84 | OAKLAND | 66 | 143 | 545 | 145 | 24 | 6 | 9 | 41 |
| 85 | OAKLAND | 66 | 143 | 545 | 145 | 24 | 6 | 9 | 41 |
| 86 | OAKLAND | 66 | 143 | 545 | 145 | 24 | 6 | 9 | 41 |
| 87 | OAKLAND | 66 | 143 | 545 | 145 | 24 | 6 | 9 | 41 |
| 88 | OAKLAND | 66 | 143 | 545 | 145 | 24 | 6 | 9 | 41 |
| 89 | ANGELS | 66 | 143 | 545 | 145 | 24 | 6 | 9 | 41 |
| 90 | ANGELS | 66 | 143 | 545 | 145 | 24 | 6 | 9 | 41 |
| 91 | ANGELS | 66 | 143 | 545 | 145 | 24 | 6 | 9 | 41 |
| 92 | ANGELS | 66 | 143 | 545 | 145 | 24 | 6 | 9 | 41 |
| 93 | ANGELS | 66 | 143 | 545 | 145 | 24 | 6 | 9 | 41 |
| 17 | CAREER | 66 | 143 | 545 | 145 | 24 | 6 | 9 | 41 |

36

TRADING CARD WITH THREE-DIMENSIONAL EFFECT

The present invention relates to trading cards, such as baseball, football, basketball, hockey and the like sports trading cards, and more particularly to a trading card providing a three-dimensional effect and related accessories.

BACKGROUND OF THE INVENTION

Trading cards are very familiar in the sports community and they are a favorite of both youngsters and adults alike. Various forms of trading cards have been developed and promoted over the years, and each typically has on one side a photograph or likeness of a sports figure and on the other side usually some statistical information about the sports figure and/or the person's team as well as another picture. Premium type cards have been developed in recent years including high quality lithography. Some cards are printed on glossy cardboard stock with crisp color photographs of the player on the front and back. Some include a form of trademark hologram to minimize counterfeiting. Although the cards usually are referred to as "trading" cards, they are today more frequently viewed as collectibles. Prominent trading card companies are The Upper Deck Company of California, Topps of New York, Fleer of Philadelphia and Score Board of New Jersey.

The usual trading card measures about three and one-half inches by two and one-half inches and is in the form of a relatively thin card having mainly an action photograph of a player on one side and some statistical information on the reverse side. The reverse side also usually carries another action photograph of the player. These cards generally are packaged either in an individual sleeve or a group within a sleeve or envelope. In some instances, the cards are packaged in envelopes of foil, instead of waxed paper, to prevent resealing and tampering with the original contents.

One form of trading card, called Tri Cards, has been promoted and which includes cut portions of cards layered with bits of wood on top of a base card to attempt to make the photo of the player appear three-dimensional. A form of card which appears similar to this is shown in Scheyer U.S. Pat. No. 3,868,283. This patent discloses an attempt to provide a three-dimensional picture, not a trading card, in which portions of a photograph are spaced away from a background by lightweight pieces of spacer material.

SUMMARY OF THE INVENTION

Although attempts such as those noted above have been made to provide more realistic trading cards or pictures, it has been found that the spacing of a picture away from a background as previously proposed does not provide a pleasing and realistic three-dimensional effect. On the other hand, it has been found that providing a cutout profile of the player bonded directly onto a background scene or photograph, preferably including the same view of the player and aligned with the cutout profile of the player, and with the profile thus being directly adjacent the background and having a relatively sharp edge on the profile provides a shadow around the player and gives a pleasing three-dimensional effect.

Accordingly, it is a principal object of the present invention to provide an improved form of trading card.

Another object of this invention is to provide an improved form of sports card.

A further object of this invention is to provide a trading card with a pleasing three-dimensional effect.

Another object of this invention is to provide a trading card having a three dimensional effect wherein a foreground profile cutout of the person is bonded directly to a master card which provides a background.

A further object of this invention is to provide an improved trading card having detailed personal information, detailed statistical information, along with a personal or family photograph or likeness on one side of a trading card, and a foreground profile likeness of the person on the other side.

Another object of the present invention is to provide a pad having a plurality of slotted areas and suitable indicia and into which areas profile cards can be placed preferably in the form of players disposed on a playing field.

Another object of this invention is to provide a new form of profile pin.

BRIEF DESCRIPTION OF DRAWINGS

These and other objects and features of the present invention will become better understood through a consideration of the following description taken in conjunction with the drawings in which:

FIG. 3 is a view showing the layout of the reverse side of the trading card of FIG. 1;

DETAILED DESCRIPTION

Figure 1:
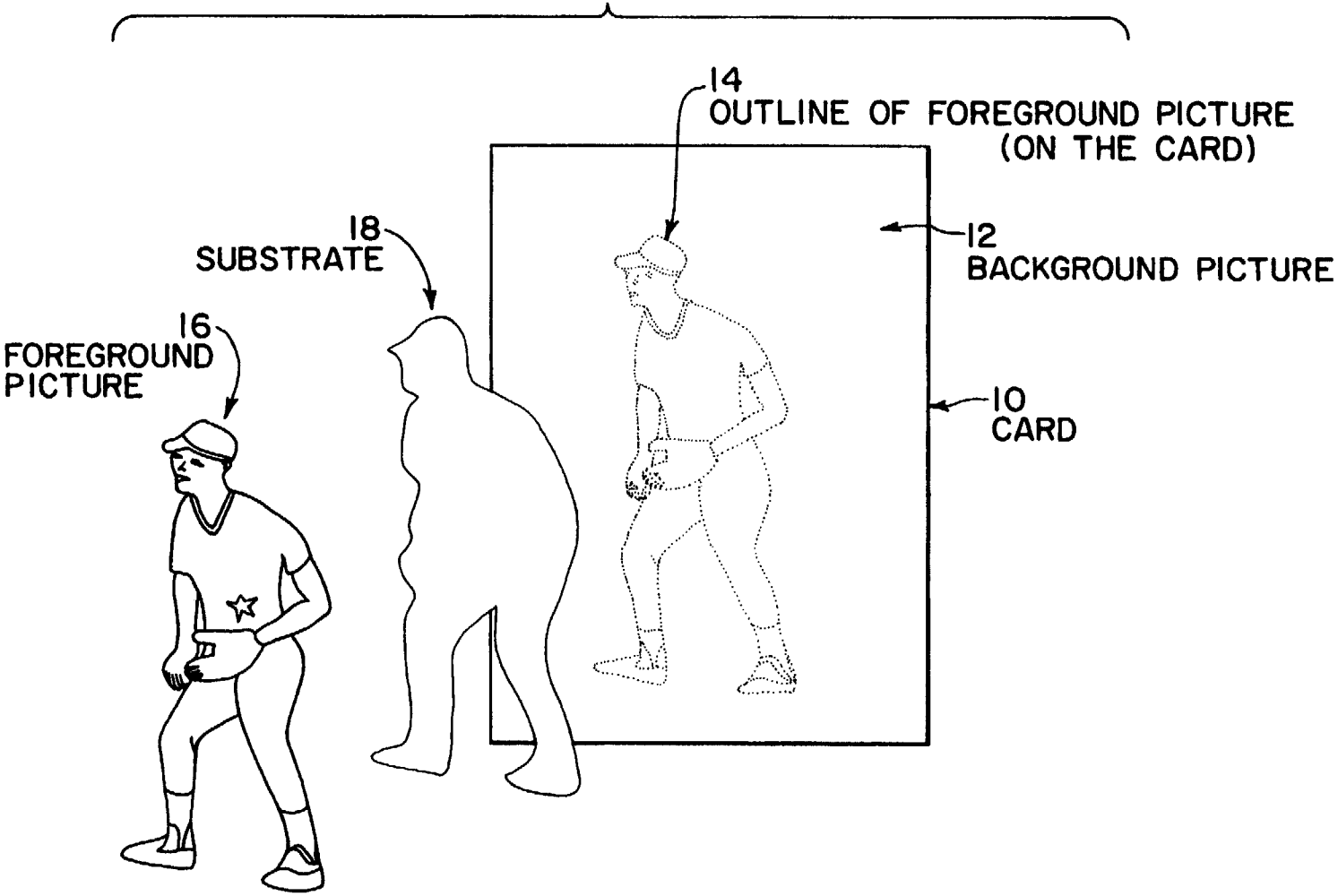
FIG. 1 is an exploded perspective view of a trading card with a three-dimensional effect according to the present invention.

According to an exemplary embodiment of the present invention, a trading card is provided of the usual basic composition having a master card substrate with a background picture preferably including an action likeness of the player on a first side, and biographical, statistical and family information printed on the second side thereof. In addition, according to the present invention, a foreground profile picture is disposed on a thin backing or substrate, and the substrate is directly bonded in intimate contact to the background picture and preferably directly aligned with a like action picture of the player. Further, the edge of the foreground picture and its substrate preferably is perpendicular or close to perpendicular so as to not only slightly space the foreground picture from the background picture but to provide a shadow or shadow effect along the edge of the foreground picture which enhances and provides a three-dimensional effect. The foreground picture and its backing (substrate) preferably is no thicker than the master card substrate and no more than ten to sixty thousandths of an inch in thickness. The second side of the card according to the present invention includes detailed biographical information of the individual portrayed on the first side of the card, as well as a small family picture and, further, detailed statistical information of the sports career (e.g., the baseball career) of the individual.

Other aspects of the present invention include providing a profile picture, preferably action picture, of a sports player on a substrate of cardboard, plastic or the like, and with a pin on the reverse side thereof to form a "profile pin" and allow it to be attached to the clothing of the owner. In addition, the present invention also provides a display pad, such as a three-quarters inch thick rubber pad having slits therein for receiving these profile players in various locations on the pad and related to the sport involved; for example, baseball in which case the slits allow the profile players to be inserted and arranged generally as they would be on a baseball field so as to provide an eye-catching and pleasing display.

The principal objectives of the present inventions are to enhance the realism of the card by making the picture of the sports person appear three-dimensional. This is accomplished primarily by slightly spacing the picture away from the background, providing a solid, mostly perpendicular edge to the picture, and maintaining all other elements of a high quality trading card essentially the same (with the exception of significant changes to the opposite side of the card as discussed subsequently).

The edge of the foreground profile, which edge is principally provided by the substrate onto which the foreground picture is printed or laminated, preferably is relatively sharp and an approximately ninety degree angle with respect to the overall card so as to provide a shadow and increase the three-dimensional effect. This edge can be sloped slightly either outwardly or inwardly with the former helping to keep a person from popping the profile picture off of the card with the fingernail, but approximately ninety degree angle is preferred.

Furthermore, an objective is to allow multiple new uses of this trading card for game playing, for pinning on clothes as an accessory or for display, and as a room decoration wherein a plurality of cards are placed in a display pad according to the present invention.

It is important to maintain the general trading card format so as to take advantage of the substantial trading card market that has been developed. Further, it is desired to maintain the overall thickness of the card close or similar to that of current cards, to minimize obstacles to inserting the card into industry standard holders or sleeves, to keep the general look of the card familiar, and to make the card as durable as existing cards.

Furthermore, an objective is to provide a card which itself can provide a reference (and as a group provide a reference set for a number of players) of detailed biographical information of the person, substantially all of the lifetime statistics for the person, and some personal family photograph or picture. Thus, in an exemplary embodiment, the second side of the present card includes this information.

Exemplary manufacturing and processing techniques for manufacturing a card according to the present invention involve use of conventional trading card manufacturing equipment and techniques, as well as new techniques. For example, an action shot of the subject is taken and suitably recorded, preferably electronically in analog or digital form. The entire picture including the subject person and background is printed onto paper or cardboard sheets in the form of multiple pictures in a conventional manner using sheet feed lithography. In order to accommodate for machine, temperature, humidity, alignment and other errors, the edges of the profile player, if present on the background, are bled inward on the background up to about one-eighth inch. Likewise and for the same reasons, the edges of the profile of the player are bled outward up to about one-eighth inch. Then the entire picture (subject and background) is printed on thin film and affixed to plastic, paper or cardboard sheets or printed directly on plastic, paper or cardboard sheets and serves as the basic member for the foreground profile. The electronic image data of the action shot of the person is fed into a laser die-cutting or die cutting mold system to respectively either laser die cut the photograph of the person along its outline (profile) from the plastic, paper or cardboard sheet or this information can be used to manufacture a cutting mold for similarly cutting the outline or profile of the person. Then the cut foreground profile is bonded in a suitable manner to the master sheet having the background preferably in precise alignment with the like profile of the subject in the background picture. Bonding can be accomplished in any suitable manner as with a suitable adhesive, heat or ultrasonic bonding, or the like. The individual trading cards are cut from the composite (foreground and background) either before or after bonding the foreground profile. Finally, the resulting cards are packaged either individually or into groups of multiple cards in a conventional manner. In the event a profile pin is desired, a suitable pin is secured to the back of each card or, alternatively, only to the substrate of the foreground profile (without the background) if desired. These latter profile cards or profile pins can be used in the display pad of the present invention.

Figure 2:
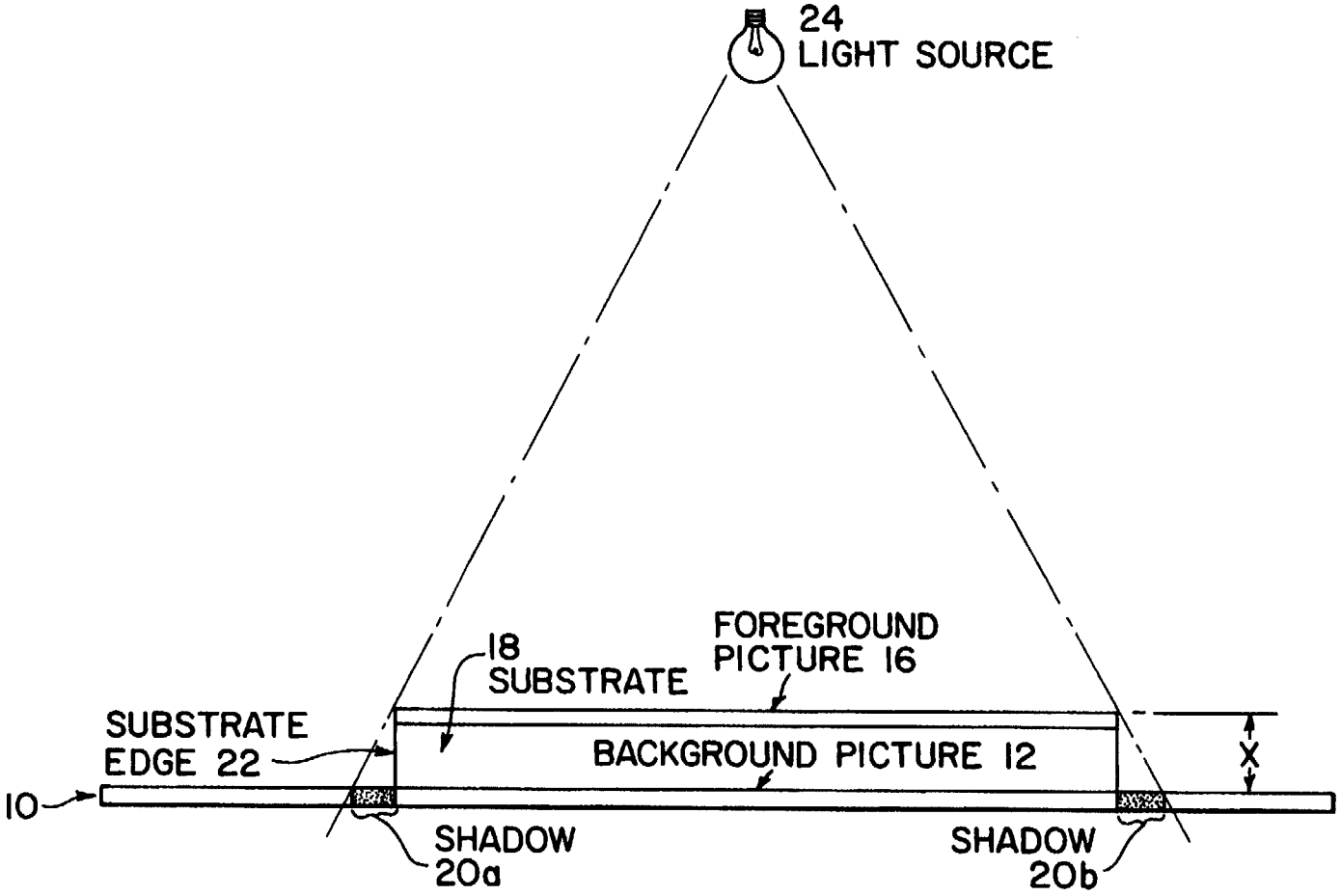
FIG. 2 is a side or cross-sectional view of the preferred trading card of FIG. 1.

Turning now to the Figures, and first to FIGS. 1 through 3, these Figures illustrate a card with a three-dimensional effect according to the present invention, with FIG. 1 essentially illustrating the first side of the card, FIG. 3 illustrating the second side of the card, and FIG. 2 illustrating a cross-sectional view of the composite card. The master card is illustrated at 10 and is essentially a conventional trading card having a background picture 12 usually including an action picture 14 of the subject player. The card 10 thus far is manufactured according to conventional trading card techniques such as those noted earlier. A copy or identical foreground picture 16 of the subject as shown at 14 is provided on a substrate 18 and bonded to the first surface of the card 10 as seen in FIG. 1 aligned with the subject player picture 14. The foreground picture 16 is typically printed directly onto the substrate 18, and the substrate 18 is bonded as by a suitable adhesive to the card 10.

This assembly results in the composite card as shown in FIG. 2 which essentially is a cross-sectional view of the card 10 having the background picture 12 printed thereon, along with the substrate 18 bonded to the card 10 and with the substrate 18 having the foreground picture 16 either printed directly thereon or laminated from a photograph thereon. The substrate 18 can be paper, cardboard, plastic or the like.

It is important that the surface of the foreground picture 16 be only slightly spaced outwardly from the background picture 12 on the card 10, and a typical distance "X" between the surface of the foreground picture 16 and the surface of the background picture 12 is forty thousandths of an inch and within the range of approximately ten to sixty thousandths of an inch. Likewise it is important that the substrate 18 have the identical profile or outline of the picture 16. This can be accomplished by bonding the picture 16 to the substrate 18 and then cutting around the profile of the person in the picture to form this profile edge. This ensures an accurate profile of the player as well as a substantially continuous profile edge around the player.

This structural arrangement enables a slight shadow as indicated at 20*a* and 20*b* from light 24 to exist around the edge 22 of the substrate 18 and picture 16 which enhances the three-dimensional effect without, in turn, causing an unrealistic or unattractive effect obtained from spacing a foreground picture away from the background in the manner disclosed in the prior art. Although the substrate edge 22 can angle outwardly or angle inwardly (undercut), it is preferred that this edge be approximately perpendicular as illustrated in FIG. 2 which provides the best shadow effect without providing essentially a gap (as would exist if the edge 22 were angled inwardly or undercut) which would more easily allow the profile picture 12, 16 to be pried off the card 10 or cause an undercut edge to catch when inserting the completed card into a sleeve.

The second or reverse side of the card 10 preferably has printed thereon information which is substantially different from that of the conventional trading card. According to the present invention, this side of the card is similar to that shown in FIG. 3 and includes a first section 30 having detailed life history information of the subject, along with a family picture or photograph in a second section 32. A third section 34 includes detailed statistical information about the person such as illustrated various averages, runs, hits, etc. for the several teams the player has played with over his career. This provides substantial information for the recipient of the card rather than the relatively sketchy information provided by conventional trading cards.

Also, this section 34 preferably includes coded information 36 in the form of bar code, magnetic, or other optical or electronically readable information. The coded information can include all of the statistical information in section 34 and/or other information that may be desired. The display pad to be described below may include a suitable reader for retrieving this information.

Figure 4:
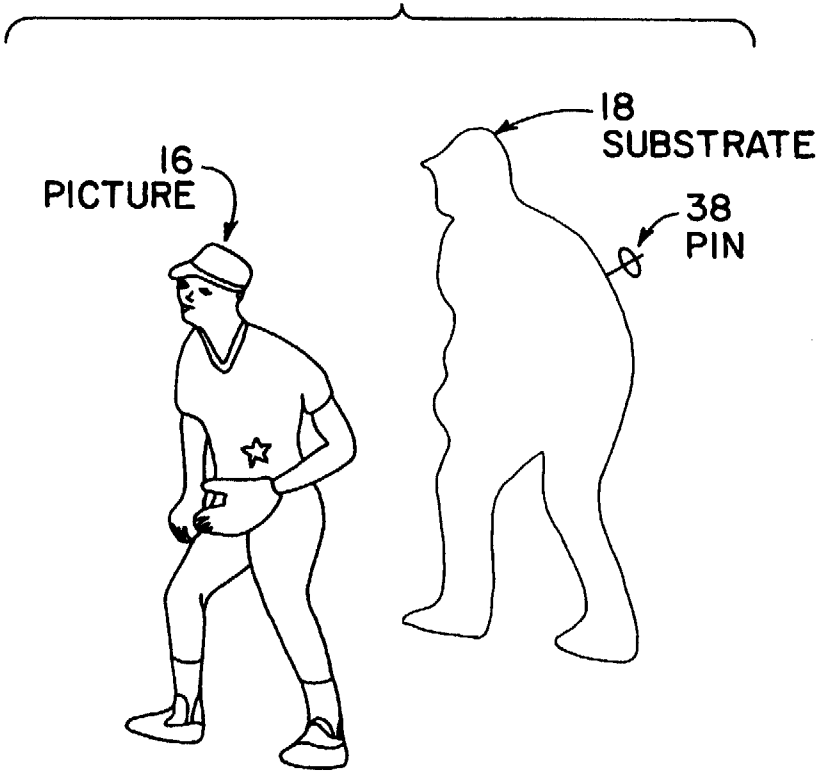
FIG. 4 is a perspective exploded view of a profile pin according to the present invention.

FIG. 4 illustrates an alternative version of the present invention wherein the foreground picture 16 is printed on or bonded to a substrate 18 again having an identical profile or outline with the picture 16. In this structure, a suitable pin 38 is secured to the back of the substrate 18 in any suitable manner, as by an adhesive, to allow the profile picture to be secured to the clothing (e.g., shirt or cap). A similar pin 38 can be mounted on the second side (FIG. 3) of the overall trading card of the embodiment of FIGS. 1–3 if desired. Furthermore, the profile pin of FIG. 4, with or without the pin 38, can be used in conjunction with a novel display pad of the present invention.

Figure 5:
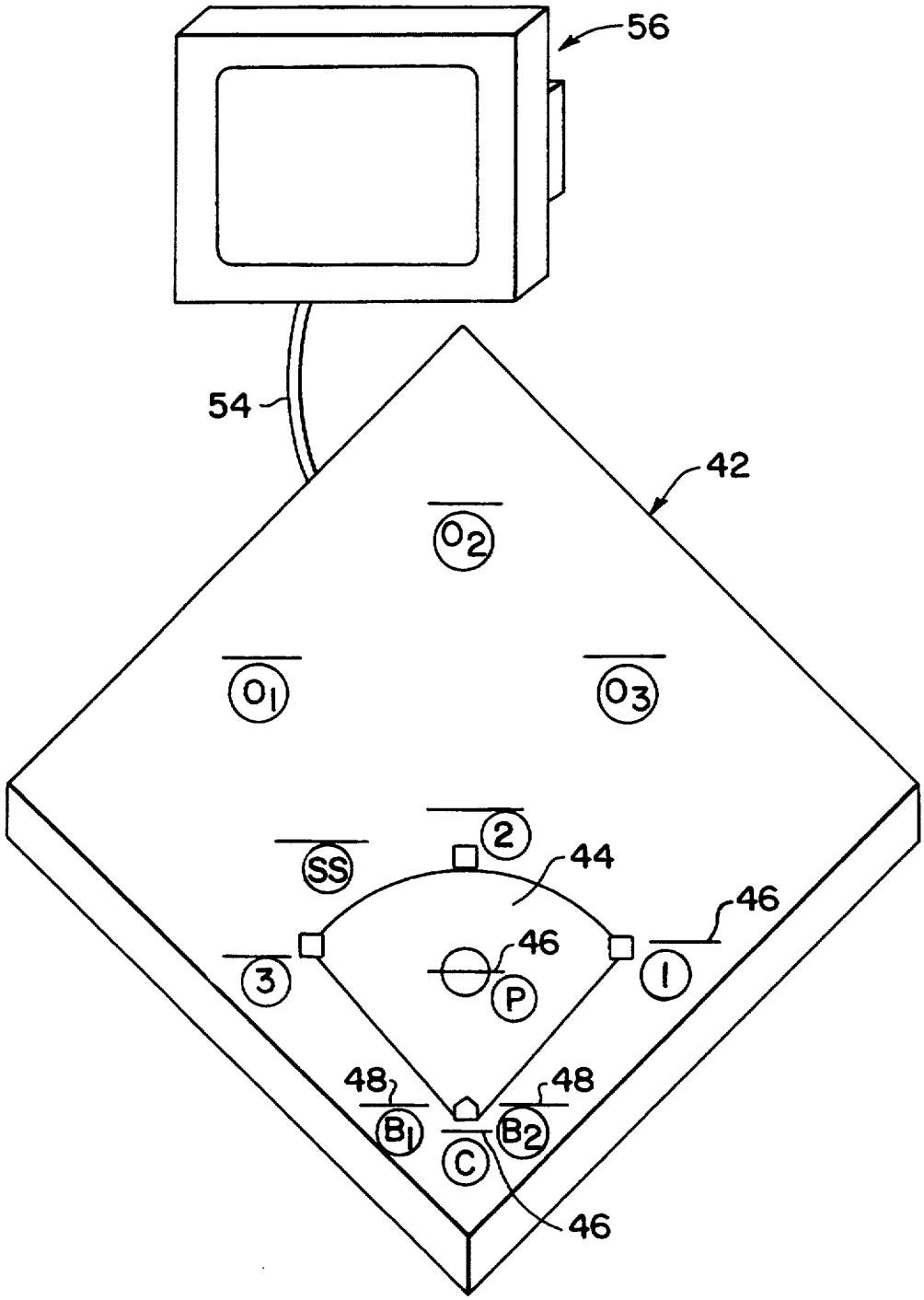
FIG. 5 is a perspective view of a display pad according to the present invention having slots or slits into which profile cards or pins can be placed in a playing field arrangement.
Figure 6:
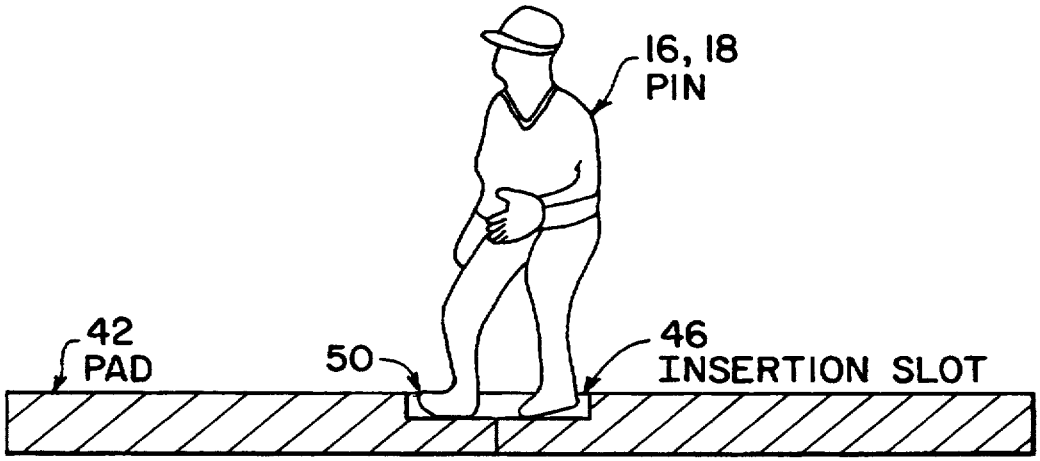
FIG. 6 is a cross-sectional view of the pad of FIG. 5 showing how the profile pin is disposed in the pad.

FIG. 5 shows in perspective a display pad 42 according to the present invention which has indicia 44 thereon simulating a sports playing field (a baseball diamond and field in this case). The display device of 42 preferably takes the form of a rubber pad having a thickness of approximately three-quarters inch, similar to but normally thicker than the computer "mouse" pads. The display 42 includes in addition to the indicia 44 on the top surface, a plurality of vertical slots or slits 46 disposed at various positions preferably relating to the particular sports field. As can be seen from FIG. 5, these slits are at the usual nine player positions on a baseball diamond and field comprising pitcher, catcher, first, second and third baseman, shortstop and three fielders. It also includes two slits 48 for right or left-hand batters. FIG. 6 shows a cross-sectional view of the display pad 42 and an exemplary slit 46 into which the composite pin 16, 18 is placed as indicated at 50. The slots or slits 46 and 48 need only be knife cuts deep and wide enough to receive and hold the bottom of the profile pin or, alternatively, the bottom of the composite card of FIGS. 1–3.

The display arrangement of FIGS. 5–6 can take any of several forms for different types of sports for displaying cards, sorting cards or game playing. The pad, if desired, also can be formed to have a number of parallel slits or slots aligned in rows. The pad 42 can take any suitable shape according to the sport involved, and can include thereon team logos, special event logos (e.g., All-Star game, World Series game, etc.), player pictures, renditions of various sports playing fields, and can emulate a baseball diamond (like FIG. 5), basketball court, football field, soccer field, and the like.

The display pad 42 may include at 50 for each slit 46 a reader for the coded information 36 from section 34. The readers can read the coded information at 36 from each card inserted into a slit 46 and provide this information via a suitable electrical cable or lines 54 to a computer 56. The data from a card or cards can be displayed on the computer or other display device and if desired can be converted into audio or voice information about the respective player.

In addition to providing cards and profile pins, the concepts of the present invention can be applied in other areas, such as photographs, postcards, greeting cards and the like. For example, regular photographs either of individuals or of scenes can be enhanced by applying the techniques disclosed herein to provide a three-dimensional effect. Features of a scene, such as St. Peter's Square, or an individual standing there, can be enhanced by providing a foreground picture such as picture 16 on a substrate 18 like shown in FIG. 1. Photographs of children, family members, individuals, groups, and the like can be provided either in a composite card form as shown in FIG. 1–2, as well as a profile pin with or without a pin 38 as shown in FIG. 4.

While embodiments of the present invention have been shown and described, various modifications may be made without departing from the scope of the present invention, and all such modifications and equivalents are intended to be covered.

What is claimed is

1. A card of the trading card type with a three-dimensional effect comprising a master card substrate having on a first surface thereof a background picture, and a foreground picture of a person on a second substrate which is cut to substantially match the profile of the person and forming a profile edge substantially all of which is bonded directly to the first surface of the card, the foreground picture being on a surface slightly spaced from the background picture by the second substrate, and the second substrate providing a substantially continuous profile edge aligned with the profile of the person which is substantially perpendicular to the first surface of the master card substrate and which, when illuminated, provides a shadow around the foreground picture to provide a three-dimensional effect.

2. A card as in claim 1 wherein the second substrate with the foreground picture is bonded directly over and aligned with a picture of a person in the background picture which is substantially identical to the foreground picture.

3. A card as in claim 1 wherein said profile edge is perpendicular to the first surface of the master card substrate.

4. A card as in claim 1 having a second surface, the second surface having printed thereon a first section containing detailed lifetime biographical information of the person, a second section comprising a family likeness or picture, and a third section containing substantially lifetime sports statistics for the person.

5. In combination with a plurality of cards of claim 1, a display pad having indicia on a surface thereof simulating a sports field, and having slots in and transverse to that surface of the display pad into which said cards can be placed for substantially vertical display thereof and the slots having an orientation related to players' positions on the sport field.

6. The card as in claim 1 wherein the card includes a second surface and further including a pin bonded to the second surface for allowing the card to be attached to clothing.

7. A profile card display comprising a plurality of profile cards each comprising an action photograph of a sports player, the action photograph being bonded to a substrate, and the photograph and the substrate being cut around the profile of the player, the edge of the photograph and the substrate being substantially coincidental and perpendicular to the surface of the picture and forming a substantially continuous profile edge, the cards comprising a plurality of profile cards of different sports players and with different action photographs, and further including a display pad having indicia on a surface thereof simulating a sports field, and having slots in that surface of the display pad into which the profile cards can be placed for display, and the slots having an orientation related to players' positions on the sport field.

8. A profile card display as in claim 7 wherein at least one substrate has a back surface opposite an image surface of the picture and includes a pin bonded thereto for allowing this card to be attached to clothing.

9. A card of the trading card type with a three-dimensional effect comprising a master card substrate having on a first surface thereof a background picture, and a foreground picture of a person on a second substrate which is cut to substantially match the profile of the person and forming a profile edge substantially all of which is bonded directly to the first surface of the card, the foreground picture being on a surface slightly spaced from the background picture, and the second substrate providing a substantially continuous profile edge adjacent the profile of the person which is substantially perpendicular to the first surface of the master card substrate, and the foreground picture and the second substrate have a thickness within a range of ten to sixty thousandths of an inch and which, when illuminated, provides a shadow around the foreground picture to provide a three-dimensional effect.

10. A card as in claim 9 wherein the substrate is bonded directly over and aligned with a picture of the person in the background which is substantially identical to the foreground picture.

11. A card as in claim 9 wherein said profile edge is perpendicular to the first surface of the master card substrate.

12. A card as in claim 9 having a second surface, the second surface having printed thereon a first section containing detailed lifetime biographical information of the person, a second section comprising a family likeness or picture, and a third section containing substantially lifetime sports statistics for the person.

13. A card with a three-dimensional effect comprising a master card substrate having on a first surface thereof a background picture, and a foreground picture of a person or scene on a second substrate which is cut to substantially match the profile of the person or scene and forming a profile edge substantially all of which is bonded directly to the first surface of the card, the foreground picture being on a surface slightly spaced from the background picture, and the second substrate providing a substantially continuous profile edge aligned with the profile of the person or scene which is substantially perpendicular to the first surface of the master card substrate, and the foreground picture and the second substrate have a thickness within a range of ten to sixty thousandths of an inch thick, and which, when illuminated, provides a shadow around the foreground picture to provide a three-dimensional effect.

14. A card as in claim 13 wherein the substrate is bonded directly over and aligned with a picture of the person or scene in the background which is substantially identical to the foreground picture.

15. A card display comprising a plurality of cards of the trading card type, each comprising an action photograph of a sports player, and the cards comprising a plurality of cards of different sports players and with different action photographs, and further including a display pad having indicia on a surface thereof simulating a sports field, and having slots in and transverse to that surface of the display pad into which the cards can be placed for display, and the slots having an orientation related to players' positions on the sport field, and at least one of the slots comprising a coded information reader adapted to read information from a card inserted into that slot to provide that information to a computer or the like, and at least one of the cards having coded information readable by the card reader when placed in the slot containing the reader.

* * * * *

US005417431C1

(12) EX PARTE REEXAMINATION CERTIFICATE (5976th)

United States Patent
Gluck

(10) Number: US 5,417,431 C1
(45) Certificate Issued: Oct. 30, 2007

(54) TRADING CARD WITH THREE-DIMENSIONAL EFFECT

(75) Inventor: Adrian Gluck, Newport Beach, CA (US)

(73) Assignee: Media Technologies Licensing, LLC, Beverly Hills, CA (US)

Reexamination Request:
No. 90/008,073, Jun. 29, 2006

Reexamination Certificate for:

| | |
|---|---|
| Patent No.: | **5,417,431** |
| Issued: | **May 23, 1995** |
| Appl. No.: | **08/147,139** |
| Filed: | **Nov. 3, 1993** |

(51) Int. Cl.

| | |
|---|---|
| ***B42D 15/00*** | (2006.01) |
| ***A63F 1/00*** | (2006.01) |
| ***G09F 1/02*** | (2006.01) |

(52) U.S. Cl. ..... 273/293; 40/124.191
(58) Field of Classification Search ..... None
See application file for complete search history.

(56) References Cited

PUBLICATIONS

Fleer 1990 Baseball Collectors Pin.
Fleer 1990 Basketball Collectors Pin.
Fleer 1990 Football Collectors Pin.
1990 Jim Abbot MVP Major League Collector Pin.
1990 Mark McGwire MVP Major League Collector Pin.
1990 Ryne Sandberg MVP Major League Collector Pin.
1991 Andre Dawson MVP Major League Collector Pin.
1991 Carlton Fisk Major League Collector Pin.
1991 Mark Grace Major League Collector Pin.

*Primary Examiner*—Michael O'Neill

(57) ABSTRACT

There is disclosed herein a new form of card of the trading card type which provides a three-dimensional effect. The card includes a master sheet or card having a background picture, along with an action picture of a person printed or disposed on a substrate and which substrate is directly bonded to the surface of the card to provide a substantially continuous profile edge around the picture and which edge preferably is substantially perpendicular to the surface of the background picture. This arrangement enables a shadow to exist along this profile edge and to give an enhanced three-dimensional effect. The reverse side of the trading card preferably has detailed biographical information, detailed life sports statistics and a family picture or likeness. An alternative embodiment includes providing a profile picture of a person on a substrate and preferably with a pin on-the reverse side to enable the same to be worn on clothing. A display pad is also disclosed which includes a plurality of slits or slots, preferably arranged like player positions on a sports field, and into which cards of the present invention can be inserted for display or other purposes. Other applications to the present techniques and electronic retrieval of information from cards also are disclosed.

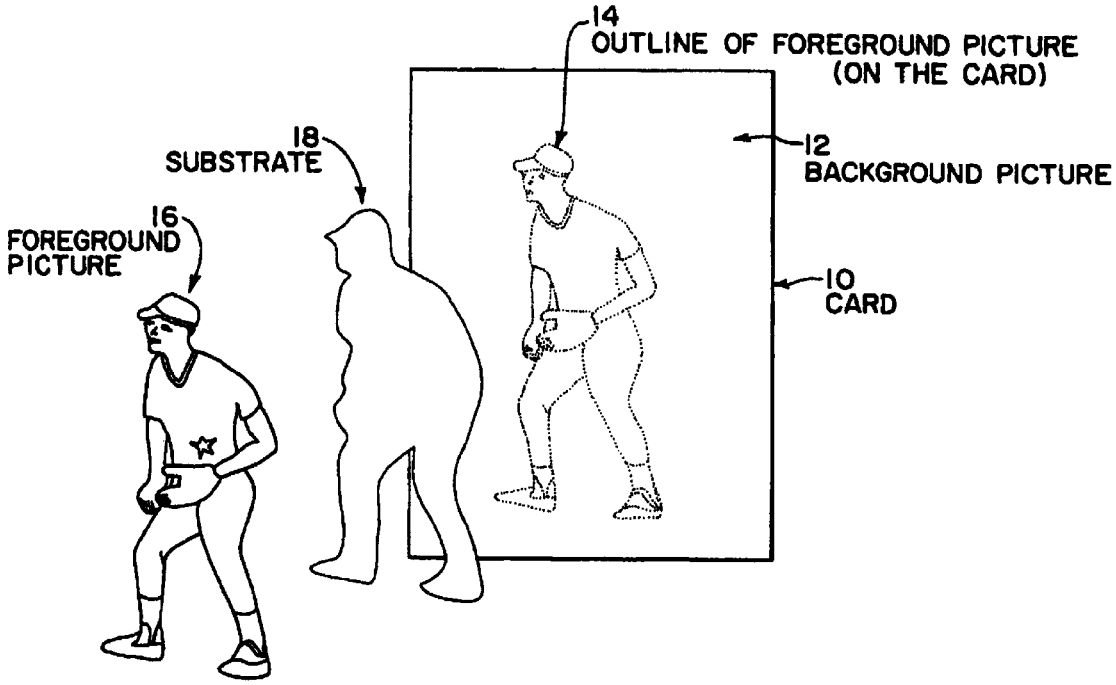

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *